United States Patent [19]

Andersen

[11] Patent Number: 4,970,782

[45] Date of Patent: Nov. 20, 1990

[54] METHOD AND APPARATUS FOR MAKING AN ELECTRICAL CONTACT

[76] Inventor: Stephen Andersen, P.O. Box 11286, Burbank, Calif. 91510

[21] Appl. No.: 451,824

[22] Filed: Dec. 18, 1989

Related U.S. Application Data

[60] Division of Ser. No. 162,740, Mar. 1, 1988, Pat. No. 4,909,763, which is a continuation-in-part of Ser. No. 886,233, Mar. 16, 1986, abandoned.

[51] Int. Cl.[5] ..... H01R 13/115; H01R 43/16

[52] U.S. Cl. ..... 29/874; 72/326; 72/332

[58] Field of Search ..... 29/874, 882; 72/324, 72/326, 332, 409, 411; 81/9.41, 9.51; 140/123, 123.6, 123.5; 439/856, 861, 862

[56] References Cited

U.S. PATENT DOCUMENTS

| | | | |
|---|---|---|---|
| 4,040,177 | 8/1977 | Baler et al. | 29/874 |
| 4,085,998 | 4/1978 | Owen | 339/258 P |
| 4,591,230 | 5/1986 | Roldan | 339/258 R |
| 4,621,421 | 11/1986 | O'Loughlin | 29/874 |

*Primary Examiner*—Timothy V. Eley
*Attorney, Agent, or Firm*—James E. Brunton

[57] ABSTRACT

A precision apparatus for controllably shearing a thin workpiece of material to make devices such as electrical contacts of the character having specially configured spaced apart tongues adapted to mate with plug connectors of standard design. The apparatus is designed to rigidly support the workpiece except in the precise area of the shear during the entire shearing step.

18 Claims, 7 Drawing Sheets

METHOD AND APPARATUS FOR MAKING AN ELECTRICAL CONTACT

This application is a division, of application Ser. No. 162,740, filed Mar. 1, 1988 now U.S. Pat. No. 4,909,763 which is a continuation-in-part application of co-pending Ser. No. 886,233 now abandoned.

BACKGROUND OF THE INVENTION

1. Field of the Invention

The present invention relates generally to electrical contacts and to a method and apparatus of making the same. More particularly the invention concerns a precision apparatus for making electrical contacts of the character having specially configured spaced apart tongues adapted to mate with plug connectors of standard design.

2. Description of the Prior Art

Various methods have been suggested in the past for the high volume manufacture of electrical contact members. In one common prior art method the contact members are stamped or lanced from a suitable piece of sheet material and the contact tongues formed or coined as necessary. Another method of making electrical contacts by one or more bending operations is described in British Patent No. 836,397. Still another method, wherein the electrical contacts are made by splitting a bar of electrically conductive metal longitudinally over a portion of its length to form two contact tongues, is described in U.S. Pat. No. 4,040,177 issued to Beeler et al.

In one form of the aforementioned Beeler et al patent, a portion of the bar to be split is enclosed between two tools. The tools are then moved, sliding along each other perpendicular to the longitudinal dimension of the bar in mutually opposed directions, over a distance with is sufficient to produce the desired splitting. In another method of splitting, the bar to be split is retained over a part of its length such that one end is free, after which a wedge is longitudinally driven into the bar through this end.

Experience has shown that in order to repeatedly produce precision electrical contacts by a splitting or skieving method, it is absolutely essential that the portions of the material immediately adjacent the boundaries of the split or slice be rigidly and positively constrained. Only in this way can a predictable controlled shear split of the material be achieved. The recognition of this problem and its novel solution is at the very heart of the present invention. As will be better appreciated from the discussion which follows, the unique apparatus of the present invention, which closely constrains the starting material along the boundaries of the skieve or split, overcomes the basic deficiencies of the prior art splitting methods, including the Beeler et al method, and for the first time permits the low cost, large volume manufacture of very high quality precision electrical contacts.

SUMMARY OF THE INVENTION

It is an object of the present invention to provide a method and apparatus for the precise manufacture of high quality electrical contacts by means of a closely controlled material skieving or splitting process. More particularly it is an object of the invention to provide an apparatus of novel design for use in making the precision electrical contacts wherein the starting material from which the electrical contacts are made is closely constrained in the area of the shear boundaries so that predictable and precisely controlled shearing of the material can repeatedly be achieved.

It is another object of the present invention to provide a method and apparatus for making electrical contacts of the aforementioned character in which material waste is minimized and manufacturing costs are kept at an absolute minimum.

Another object of the invention is to provide an apparatus of the character described in the preceding paragraphs which is of a simple straightforward design requiring a minimum amount of maintenance.

Still another object of the invention is to provide a method and apparatus of the character described which is easy to use by untrained workmen and is readily susceptible of automating to accomplish very high volume production rates.

BRIEF DESCRIPTION OF THE DRAWINGS

FIG. 8 is a front view of the electrical contact made in accordance with the method of the present invention after final forming over a mandrel or the like.

DESCRIPTION OF THE INVENTION

Figure 1:
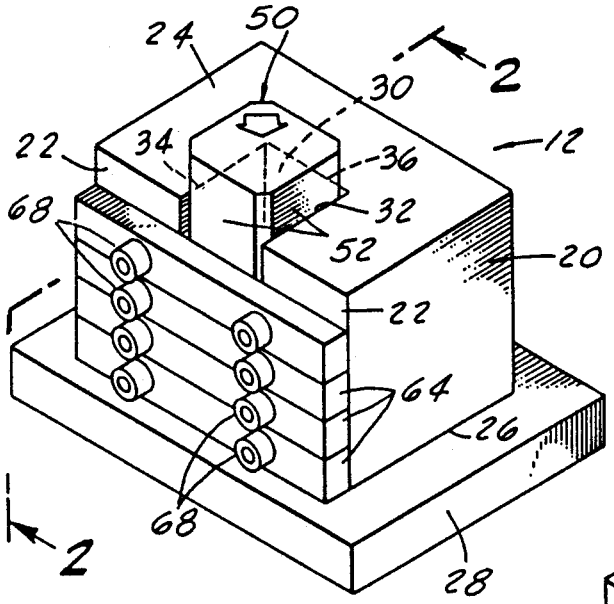
FIG. 1 is a generally perspective view of one form of the apparatus of the invention for forming electrical contacts.
Figure 3:
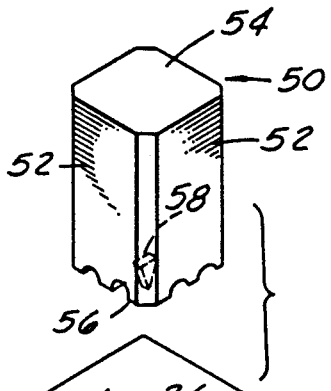
FIG. 3 is an exploded view of the apparatus for making electrical contacts in accordance with the method of the invention.
Figure 3:
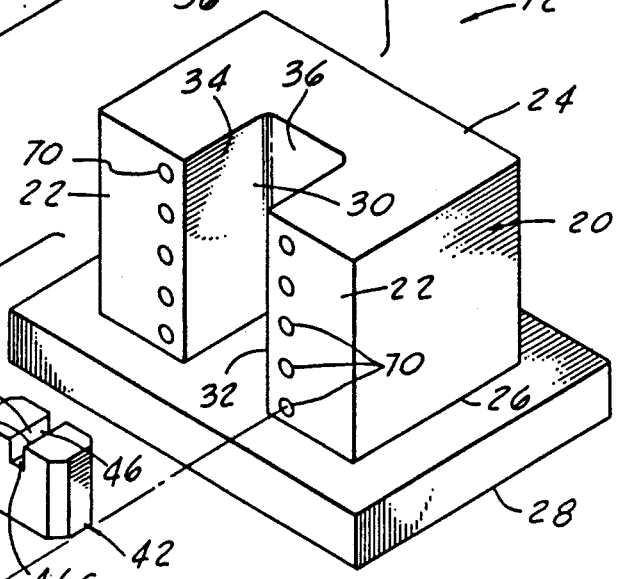
Figure 3:
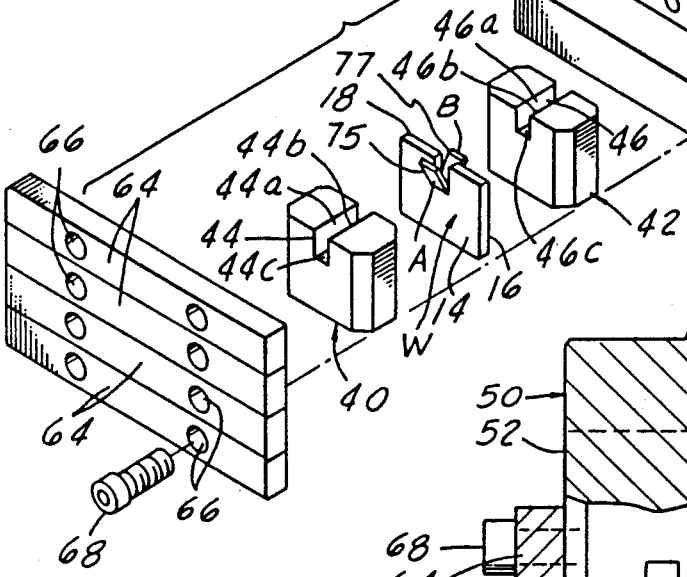
Figure 2:
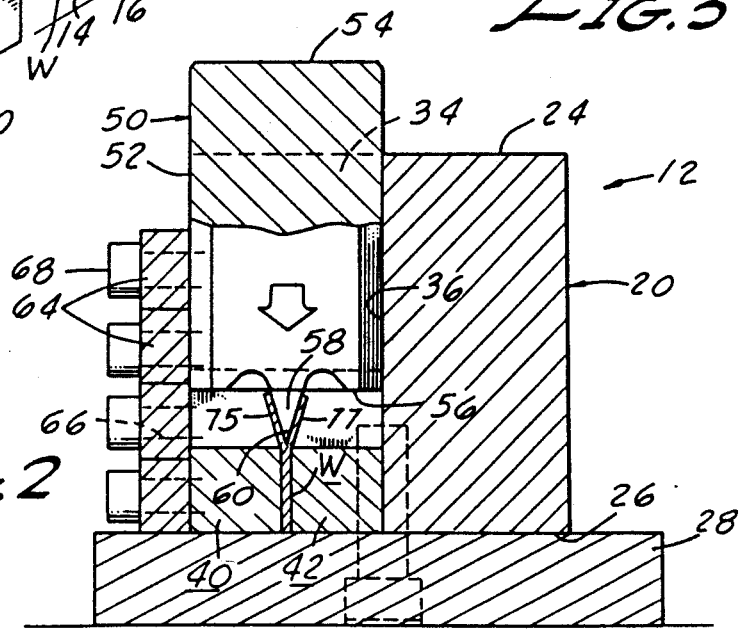
FIG. 2 is an enlarged cross-sectional view taken along lines 2—2 of FIG. 1.

Referring to the drawings, and particularly to FIGS. 1, 2 and 3, one form of the apparatus for making an electrical contact member from a generally planar shaped workpiece of electrically conductive material is generally designated by the numeral 12. As best seen in FIG. 3, the starting material, or workpiece "W", used in the practice of the method of the present invention has first and second generally parallel faces 14 and 16 of a predetermined area terminating in a perpendicularly extending third face, or edge, 18 of a predetermined width.

The apparatus 12 comprises a die portion including a supporting body 20 having a first, or front, face 22, a second, or top, face 24 and a bottom face 26 adapted to rest on a generally planar, rectangular base 28. A vertically extending, generally "U" shaped punch receiving channel 30 is formed in body member 20. As best seen in FIG. 3, channel 30 is defined by transversely spaced, generally parallel side walls 32 and 34 which join with a perpendicularly extending back, or end, wall 36.

Closely receivable within the lower portion of channel 30 are workpiece supporting means for continuously rigidly supporting the first and second faces 14 and 16 of the workpiece "W". In the form of the invention illustrated in FIGS. 1 through 3, the workpiece supporting means comprises supporting elements 40 and 42. Elements 40 and 42 support the entire faces 14 and 16 of the workpiece save in the areas "A" and "B" which correspond to the cross-sectional area of transverse grooves 44 and 46 formed in the elements 40 and 42. Similarly, in the second form of the apparatus of the invention illustrated in FIG. 11, the workpiece supporting means support the first and second faces of the workpiece throughout the entire area of the first and second faces save for an area designated by the letter "C" in FIG. 11. Area "C" on face 14 of the workpiece "W" is of a predetermined width and length corresponding to the width and length of groove 44 formed in element 40. As indicated in FIG. 11 this first unsupported area extends downwardly from the third face, or edge, 18 of the workpiece "W".

It is to be observed that in both the first and second forms of the apparatus of the invention, supporting element 40 is provided with a transversely extending channel 44 therethrough, which channel has a cross-sectional area substantially corresponding to the previously identified unsupported areas "A" and "C". As seen in FIGS. 3 and 11, channel 44 is defined by spaced apart parallel walls 44*a* and 44*b* which join with a perpendicularly extending bottom wall 44*c*.

In the first form of the apparatus of the invention shown in FIGS. 1 through 3, supporting element 42 is also provided with a transversely extending channel 46 which is defined by downwardly extending spaced apart parallel side walls 46*a* and 46*b* which join with in a perpendicularly extending bottom wall 46*c*. As indicated in FIG. 3, the cross-sectional area of channel 46 is equal to unsupported area "B" on face 16 of the workpiece "W". In the discussion which follows, it will become apparent that areas "A" and "B" are equal to the sheared areas, or tongues, formed in the workpiece depicted in FIG. 3, while area "C" is equal to the area of the skieved, or tongue, portion formed in the workpiece shown in FIG. 11 and identified therein by the numeral 49.

Figure 11:
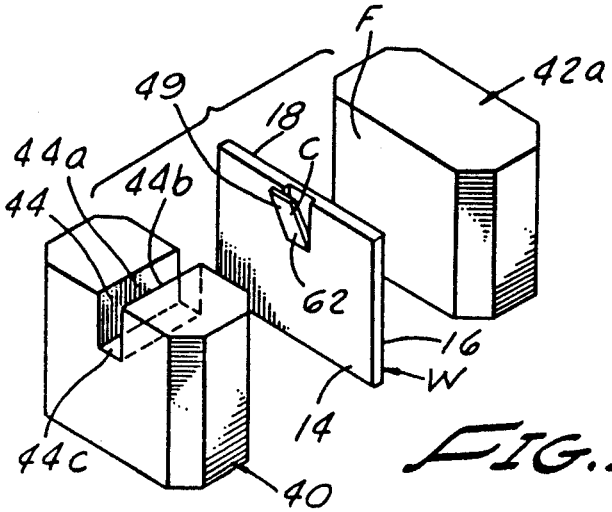
FIG. 11 is an exploded view similar to FIG. 3 showing the appearance of a rough form electrical contact after having been formed using the form of the apparatus of the invention illustrated in FIGS. 9 and 10.

Referring particularly to FIG. 11, it is to be noted that the second supporting element, designated in this figure by the numeral 42*a*, does not have a transversely extending channel formed therein. Rather, the entire front face "F" of supporting element 42*a* provides support to the entire second, or rear, face 16 of the workpiece "W".

Figure 9:
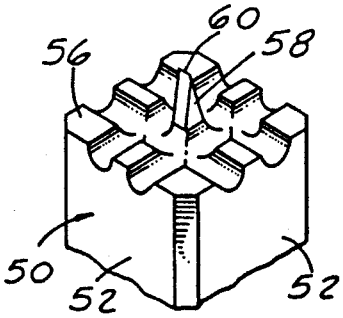
FIG. 9 is a fragmentary perspective view of the form of punch used in connection with a apparatus of the invention shown in FIGS. 1 through 3.

Turning again to FIGS. 1 through 3, the apparatus of the form of the invention thereshown further includes shearing, or punch, means closely receivable within channel 30 of the supporting body 20 for reciprocal movement therewithin. The function of the shearing means is to impart a shearing force to the third face, or edge, 18 of the workpiece "W" at a location intermediate the first and second faces 14 and 16. The shearing means, shown here as punch 50, includes interconnected side walls 52 which terminate in a upper wall 54 and a lower wall 56. As best seen by also referring to FIG. 9, extending downwardly or outwardly from end wall 56 of the punch 50 is cutter element 58 which has the shape of an isosceles triangle in longitudinal cross-section with the apex thereof terminating in a cutting edge 60. As indicated in FIG. 1, punch 50 is closely receivable within channel 30 of body 20 and is controllably movable downwardly in the direction of the arrow of FIG. 1.

Figure 10:
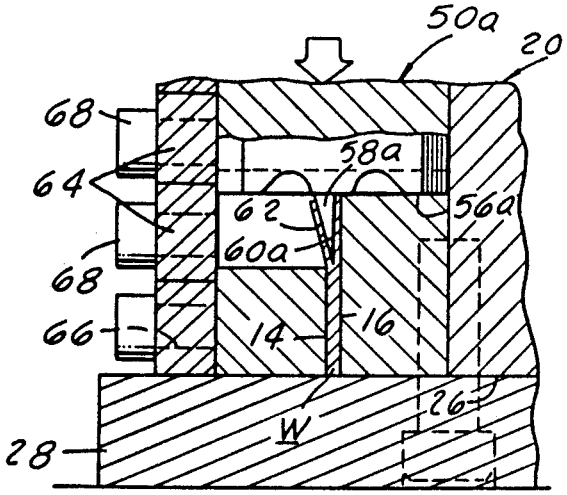
FIG. 10 is a side elevational, cross-sectional fragmentary view of an alternate form of the apparatus of the invention embodying a die similar to that illustrated in FIG. 1. This form of the apparatus of the invention makes use of a slightly different punch and is used in forming the electrical contact by skieving the material held captive within the die.

In both forms of the apparatus of the invention shown in the drawings, the workpiece clamping or supporting elements 42 and 44 are provided with opposing faces adapted to be brought into pressural engagement with faces 14 and 16 respectively of the workpiece. The supporting or clamping elements 40 and 42 are maintained in pressural engagement with the faces of the workpiece "W" by means of a plurality of stacked bars 64 which are interconnected with face 22 of body 20. As best seen in FIGS. 3 and 10, each of the bars 64 is provided with spaced apart apertures 66 which receive threaded connectors 68, which connectors are threadably received within internally threaded apertures 70 formed in the forward face 22 of body 20. As indicated in FIG. 1, with stacked bars 64 securely affixed to supporting body 20 in the manner shown, punch 50 is closely receivable within an area defined by the rear face of stacked bars 64 and the side and end walls 34 and 36 of channel 30.

Turning once again to FIG. 10, wherein a second form of the apparatus of the invention is shown, the punch, there designated by the numeral **50*a*, is of similar construction to punch 50 having a lower end wall 56*a*. Extending outwardly or downwardly from end wall 56*a* is a cutter element of slightly different configuration from that shown in FIGS. 3 and 9. More particularly, this cutter element, designated by the numeral 58*a*, has the longitudinal cross-sectional shape of a right triangle terminating at its apex in a cutting edge 60*a*. As will presently be discussed, the apparatus of the second form of the invention shown in FIGS. 10 and 11 is used in skieving, or slicing, the workpiece "W" in a predeterminable controlled manner to form a tongue 62 (FIG. 11**).

In practicing the method of the invention using the apparatus of the form of the invention shown in FIGS. 1 through 3, after the clamping bars 64 are removed from the face of the die body 20 supporting element 42 is inserted into the lower portion of "U" shaped channel 30 with its base resting on base 28. The workpiece "W" is next inserted into the "U" shaped channel with face 16 thereof in surface contact with the outwardly extending face of supporting element 42. With the workpiece in place, supporting element 40 is then inserted into channel 30 of the die body so that the rear face thereof is in intimate contact with the front face 14 of the workpiece "W". Next, the clamping bars 64 are interconnected with the front face 22 of the die body 20 by means of threaded connectors 68 so as to securely clamp the workpiece between elements 40 and 42. It is important to note that with the workpiece clamped in the die in the manner thus described, the first and second faces of the workpiece are firmly and securely supported throughout the entire area of their opposing faces save for the first unsupported area "A" and the second unsupported area "B" (FIG. 3) which are coextensive with the cross-sectional areas of transversely extending grooves 44 and 46 formed in supporting elements 40 and 42.

With the workpiece supported within the die in the manner described in the preceding paragraphs, the punch 50 is then inserted into the channel defined by the rear faces of clamping bars 64 and the faces of the "U" shaped channel 30 formed in die body 20. In the embodiment of the invention shown in FIGS. 1 through 3, the cutting portion 58 of the punch 50, which is in the cross-sectional shape of an isosceles triangle, contacts the workpiece "W" so that the cutting edge 60 precisely bisects the upper edge portion 18 of the workpiece. A downward force exerted on the punch 50 in the direction of the arrow in FIG. 1 will cause the workpiece to be sheared in the manner shown in FIGS. 2 and 3 forming angularly diverging tongues 75 and 77. After shearing, tongue 75 will have an area precisely equal to the area "A" which, as previously noted, is equal to the cross-sectional area of groove 44. Similarly, tongue 77 will have an area "B" which is precisely equal in area to the cross-sectional area of groove 46 formed in support element 42.

An important aspect of the present invention resides in the fact that because the workpiece "W" is rigidly clamped between supporting elements 40 and 42 with faces 14 and 16 being supported throughout their entire areas, save for the areas "A" and "B", the downward force of the punch 50 effects a true shearing action of the unsupported areas "A" and "B" along side shearlines which are coextensive with the transversely spaced edges of the grooves 44 and 46 respectively. This positive support of the workpieces immediately adjacent the shearlines of areas "A" and "B" permits a degree of precise repeatability which is not possible with prior art devices presently in use.

Turning now to FIGS. 10 and 11, the apparatus of this form of the invention is used to controllably skieve a layer of the workpiece "W" to form a tongue having a predetermined precisely controlled width and length. As indicated in FIG. 10, the support elements 40 and **42*a* are supported within in die body 20 in the same manner as previously discussed herein. However, in this form of the invention, support element 42*a* provides support to the entire rear face 16 of the workpiece, while support element 40 provides support to the face 14 of the workpiece "W" throughout its entire area, save the unsupported area designated in FIG. 11 by the letter "C". As previously mentioned, this unsupported area is coextensive with the cross-sectional area of the groove 44 formed in support element 40**.

In addition to the different manner in which the workpiece "W" is supported in the apparatus of the second form of the invention, it is to be noted that punch **50*a* is also of a different configuration. More particularly, the cutting element of punch 50*a*, while in the shape of a triangle in longitudinal cross-section, takes the shape of a right triangle, rather than an isosceles triangle, with the apex of the triangle forming the cutting edge 60*a***.

Once the workpiece "W" is securely clamped between clamping elements 40 and **42*a*, a downward pressure on punch 50*a* in the direction of the arrow in FIG. 10 will bring the cutting edge 60*a* into contact with the upper edge 18 of the workpiece "W" at a precisely determined location intermediate faces 14 and 16 of the workpiece. A continued downward force on punch 50*a* will cause the controllable skieving of a layer of material having an area "C", which area is coextensive with the cross-sectional area of the groove 44 formed in clamping element 40. Once again, because the entire area of faces 14 and 16 of the workpiece are positively supported, save for the area designated by the letter "C", a downward movement of the punch 50*a* will cause a precise skieving of a layer of material of predetermined thickness to form a tongue of the character designated by the numeral 49 in FIG. 11. This precise skieving of the material can be reproduced time after time because of the rigid support and positive constraint of the workpieces in the immediate proximity of the shearline defined by the edges of groove 44 in element 40**.

Figure 4:
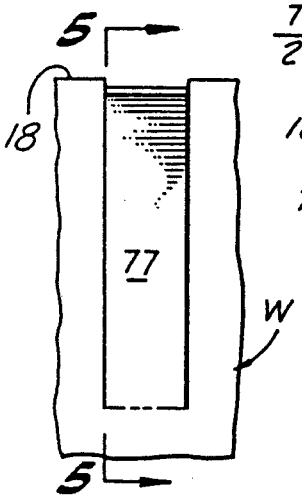
FIG. 4 is a fragmentary view of the rough form electrical contact made in accordance with the method of the invention.
Figure 5:
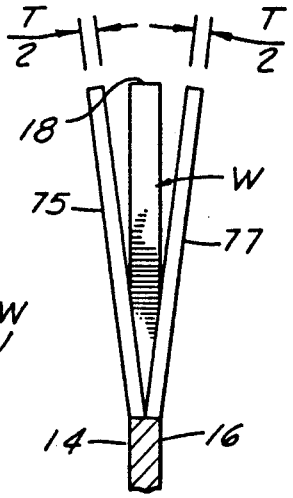
FIG. 5 is a cross-sectional view taken along lines 5—5 of FIG. 4.
Figure 6:
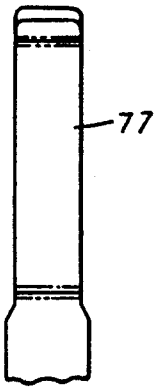
FIG. 6 is a fragmentary side elevational view of the electrical contact after blanking, coining and pre-forming.
Figure 7:
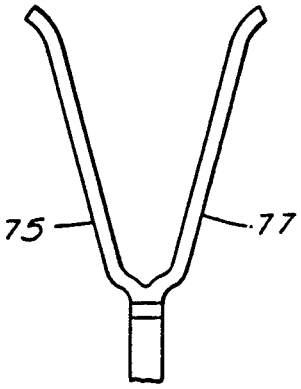
FIG. 7 is a front view of the electrical contact further showing the configuration of the contact after coining and pre-forming.
Figure 8:
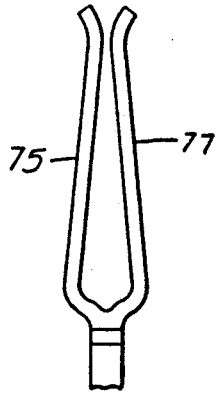

Following the shearing, or skieving, of the workpiece in the manner described in the preceding paragraphs, the electrical contact is finished in the manner illustrated in FIGS. 4 through 8. Referring particularly to FIGS. 4 and 5, after shearing the workpiece "W" using the apparatus of FIGS. 1, 2 and 3, the rough electrical contact thus formed has angularly diverging tongues 75 and 77 each having a thickness of one-half the thickness of the workpiece "W". Following the shearing step, the workpiece is removed from the die, the tongues 75 and 77 are bent into a closed position and the contact is blanked to the desired contour as, for example, that shown in FIG. 6. Next the tongues 75 and 77 are, once again, spread apart and the contact is coined and preformed into the desired configuration as for example that shown in FIG. 7. Finally, as a last step in forming the electrical contact, the contact of the configuration shown in FIG. 7 is bent into final form over a mandrel, or the like, to form the contact in a final configuration as, for example, that shown in FIG. 8.

Figure 12:
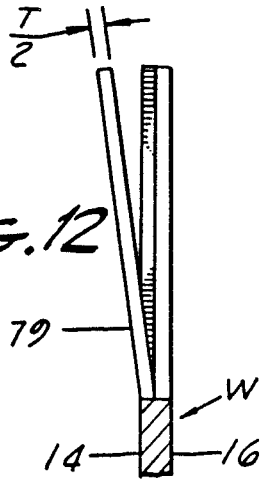
FIG. 12 is a side view, partly in section, of the rough form electrical contact made by the skieving method using the apparatus of FIGS. 9 and 10.

Referring now to FIG. 12, it is to be understood that the rough electrical contact thereshown was formed by the skieving method using the apparatus illustrated in FIGS. 10 and 11.

This electrical contact includes an outwardly extending tongue 79 having a thickness approximately equal to one-half the thickness of the starting workpiece "W". The rough electrical contact of the configuration illustrated in FIG. 12 is prefinished into the desired final configuration in the same general manner as previously discussed in connection with the finishing of the contact depicted in FIG. 5.

It should be appreciated that the apparatus shown in the drawing is, for sake of simplicity, depicted as a single punch and die acting upon a single discrete workpiece "W". In the actual commercial practice of the method of the invention, the apparatus would be mechanized so that a continuous length of starting material would be fed through an automated punch and die apparatus to continuously shear or skieve the material to form rough contacts which would then be configured and formed into end product electrical contacts on a continuous basis. However, because the production apparatus forms no part of the present invention, the details thereof are neither shown in the drawings, nor described herein.

It should also be observed that the configuration of the electrical contacts as shown in FIGS. 4 through 8 and 12 are exemplary only. The apparatus of the invention can be used to produce electrical contacts having a wide variety of tongue shapes and thicknesses depending upon the end use to be made of the contacts.

Figures 13, 14:
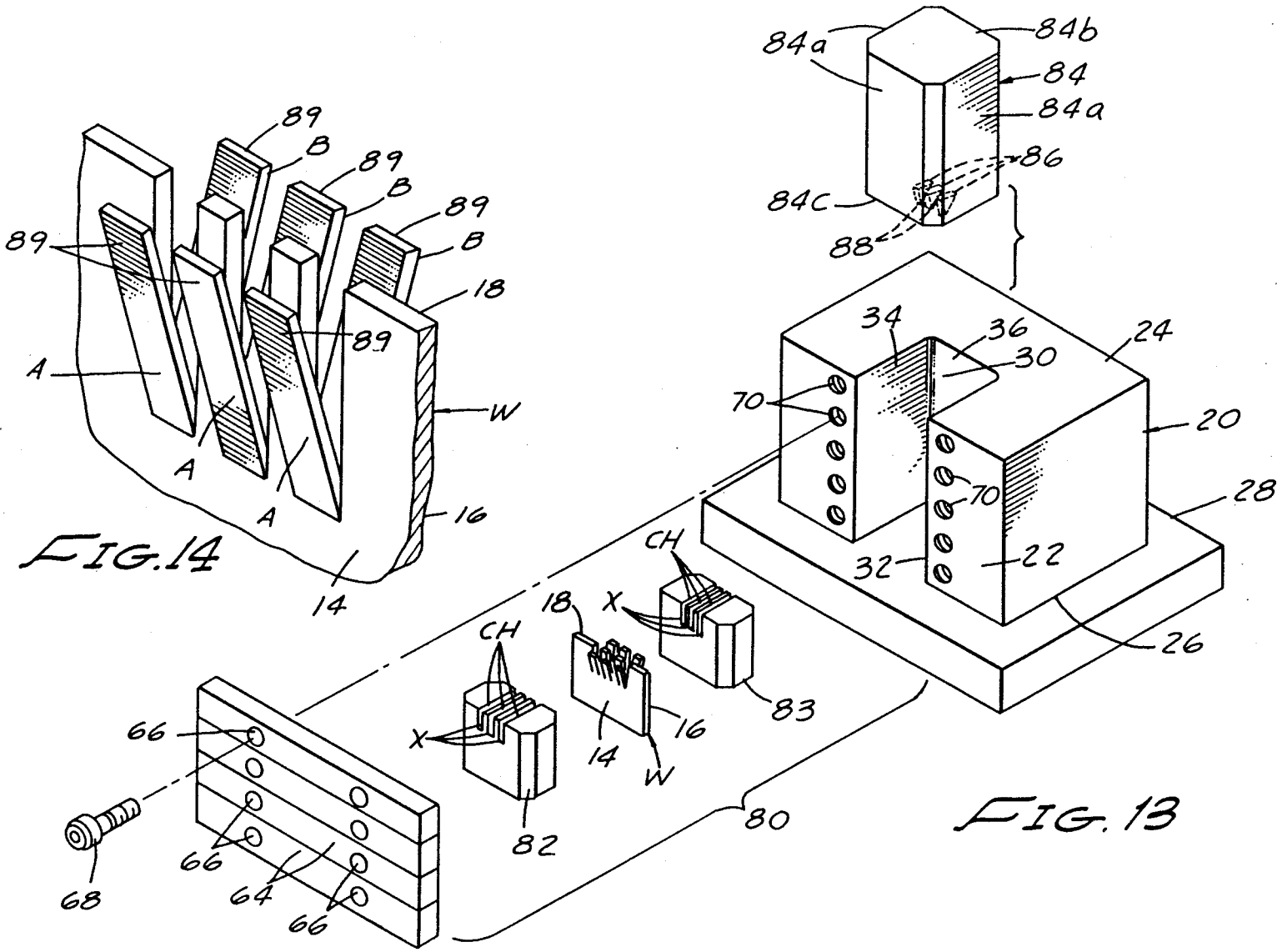
FIG. 13 is an exploded view of an alternate form of the apparatus of the invention capable of simultaneously forming a plurality of electrical contacts.
FIG. 14 is an enlarged fragmentary, generally diagrammatic view of the workpiece following formation of the rough contacts.

Turning now to FIGS. 13 and 14, an alternate approach to the shearing tool design and workpiece shearing operation of the present invention is there illustrated. The apparatus shown in FIG. 13 is somewhat similar to that shown in FIGS. 1, 2 and 3 and like numerals are used in FIG. 13 to identify like components. Unlike the apparatus earlier described, the apparatus shown in FIG. 13 is capable of simultaneously forming a plurality of electrical contacts rather than one. As in the previously described embodiment, the starting material or workpiece "W", used in the practice of the method of the present invention, has first and second generally parallel faces 14 and 16 of a predetermined area terminating in a perpendicularly extending third face, or edge, 18 of a predetermined width.

The apparatus 80 comprises a die portion including a supporting body 20 having a first, or front, face 22, a second, or top, face 24 and a bottom face 26 adapted to rest on a generally planar, rectangular base 28. A vertically extending, generally "U" shaped punch receiving channel 30 is defined by transversely spaced, generally parallel side walls 32 and 34 which join with a perpendicularly extending back, or end, wall 36.

Closely receivable within the lower portion of channel 30 are workpiece supporting means for continuously supporting the first and second faces 14 and 16 of the workpiece "W". In the form of the invention illustrated in FIG. 13 the workpiece supporting means comprises supporting elements 82 and 83. Elements 82 and 83 support substantially the entire faces 14 and 16 of the workpiece save in the areas which correspond to the cross-sectional area of transverse grooves "X" formed in the elements 82 and 83.

It is to be observed that supporting element 82 is provided with transversely extending channels CH therethrough, which channels each have a cross-sectional area substantially equal to the unsupported areas "A" on workpiece "W". Each channel CH is defined by spaced apart parallel walls which join with a perpendicularly extending bottom wall.

Supporting element 83 is also provided with transversely extending channels CH, each of which is defined by downwardly extending spaced apart parallel side walls which join with in a perpendicularly extending bottom wall. The cross-sectional area of these channels is substantially equal to the unsupported areas "B" on face 16 of the workpiece "W". Areas "A" and "B" are equal to the sheared areas, or tongues, simultaneously formed in the workpiece depicted in FIG. 14.

Turning again to FIG. 13, the apparatus of the form of the invention thereshown further includes shearing, or punch, means closely receivable within channel 30 of the supporting body 20 for reciprocal movement therewithin. The function of the shearing means is to impart shearing forces to the third face, or edge, 18 of the workpiece "W" at locations intermediate the first and second faces 14 and 16. The shearing means, shown here as punch 84, includes interconnected side walls **84*a* which terminate in an upper wall 84*b* and a lower wall 84*c*. Extending downwardly or outwardly from end wall 84*c* of the punch 84 are cutter elements 86 each of which has the general shape of an isosceles triangle in longitudinal cross-section with the apex thereof terminating in a cutting edge 88. As indicated in FIG. 13, punch 84 is closely receivable within channel 30 of body 20** and is controllably movable in a downwardly direction.

As in the earlier forms of the apparatus of the invention shown in the drawings, the workpiece clamping or supporting elements 82 and 83 are provided with opposing faces adapted to be brought into pressural engagement with faces 14 and 16 respectively of the workpiece. The supporting or clamping elements 82 and 83 are maintained in pressural engagement with the faces of the workpiece "W" by means of a plurality of stacked bars 64 which are interconnected with face 22 of body 20. Each of the bars 64 is provided with spaced apart apertures 66 which receive threaded connectors 68, which connectors are threadably received within internally threaded apertures 70 formed in the forward face 22 of body 20. With stacked bars 64 securely affixed to supporting body 20, punch 84 is closely receivable within an area defined by the rear face of stacked bars 64 and the side and end walls 34 and 36 of channel 30.

Practice of the method of the invention using the apparatus of the form of the invention shown in FIGS. 13, is substantially as previously described herein. However, with the configuration of the apparatus shown in FIG. 13, three pairs of tongues 89 of the general character illustrated in FIG. 14, will simultaneously be formed. Due to the novel character of the method and apparatus of the present invention, the spacing between the centerlines of tongues 89 can be closely controlled.

The apparatus is readily adaptable to enable high volume fabrication of strips of contacts having conventional 0.100 inch and 0.050 inch centers. Additionally, for the first time, fork style contacts of of given thicknesses can be produced on very small center distances ranging down to about 0.010 inches. This has substantial economic advantages in that meaningful material savings can be realized, and also for the first time, an integral comb, or strip, of contacts on extremely small center distances can be formed and assembled into a connector housing as a unit rather than as individual contacts, as is typical in the prior art.

Figure 15:
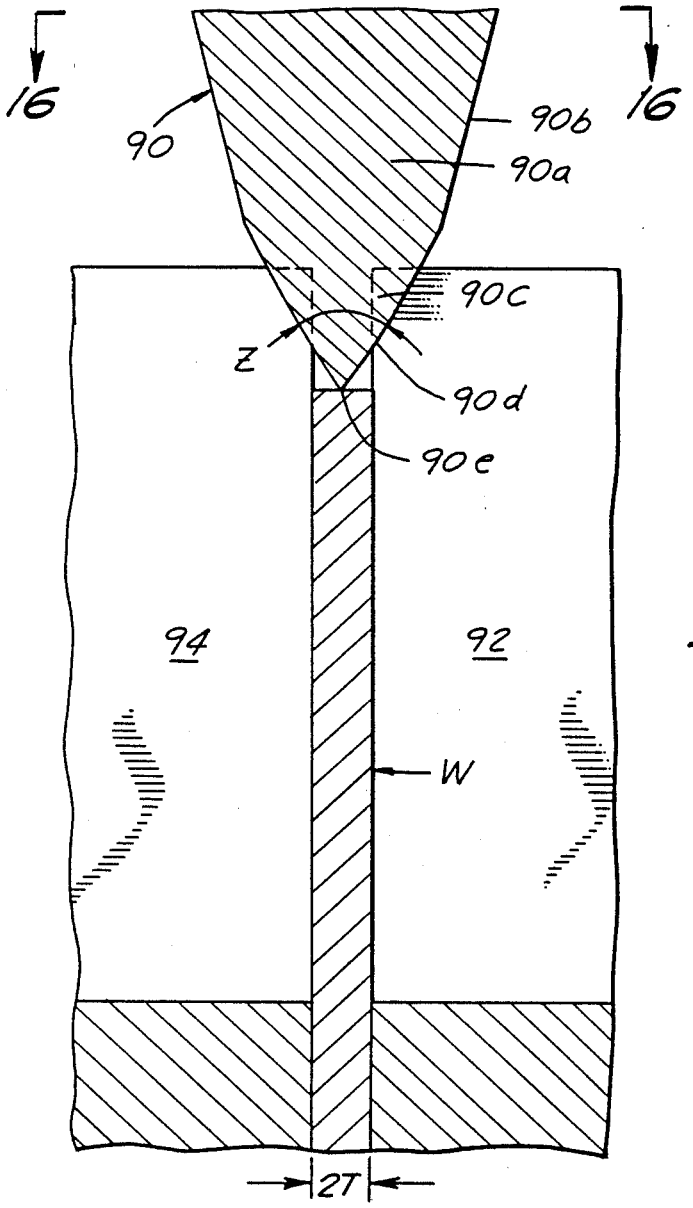
FIG. 15 is a generally schematic view illustrating an alternate form of splitting punch moving into initial contact with the work material, which work material is clamped securely within the clamping die of the apparatus.

Turning now to FIG. 15, a shearing punch, generally identified by the numeral 90, can be seen to be of a different design than the earlier described elements. The punch 90 is provided with a body portion 90*a* having inwardly tapering side walls 90*b* and a workpiece engaging portion 90*c* also having inwardly tapering walls identified as 90*d* which walls converge to form an apex 90*e*. Apex 90*e* forms the cutting edge of the punch and is preferably somewhat rounded rather than being a sharp edge. As will be discussed in greater detail hereinafter, by judiciously selecting a predetermined included angle "Z" of on the order of sixty degrees, several unique and unexpected results are achieved during the shearing operation. One of these results, which is extremely important in the forming of electrical contacts, is an unexpected burnishing effect which automatically produces a highly polished contact surface as the workpiece is controllably sheared. Another unexpected result is the progressive increase in thickness of the tongue portions during the shearing process so that the finished tongues have an average thickness greater than one half the thickness of the starting workpiece. Still another unexpected result of the shearing operation is the overall shortening of the length of the tongue portions with respect to the length of the unsupported areas of the workpiece. These surprising results will be discussed in greater detail hereinafter.

Figure 16:
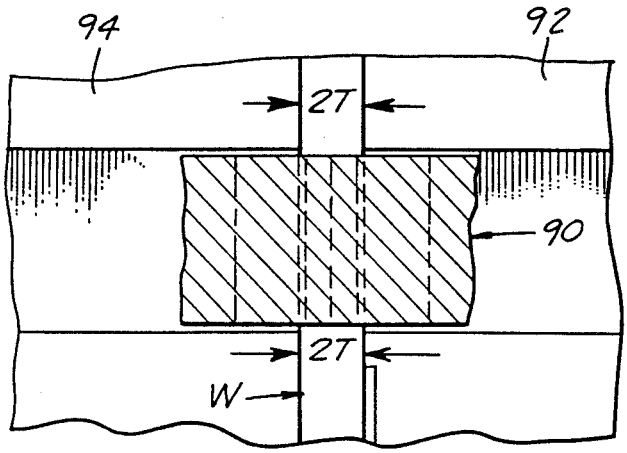
FIG. 16 is a fragmentary view partially in cross-section taken along lines 14—14 of FIG. 13.

As was the case in the shearing operation shown in FIG. 2, and as indicated in FIGS. 15 and 16, the workpiece W is closely supported by supporting, or clamping, means comprising clamping elements 92 and 94. As previously discussed, these important clamping elements support the faces of the workpiece as the splitting tool, or punch element, advances in the manner shown in FIG. 17. As pointed out in connection with the previously described embodiments of the invention, this support of the opposing faces of the workpiece in the areas proximate the material shear is of substantial importance to the accomplishment of the method of the invention and to the production of electrical contacts having the unusual configuration described in the preceding paragraph. Experimentation has shown that, while very small clearances between the workpiece and the clamping means is possible, the quality of the contacts produced tends to degrade.

Figure 17:
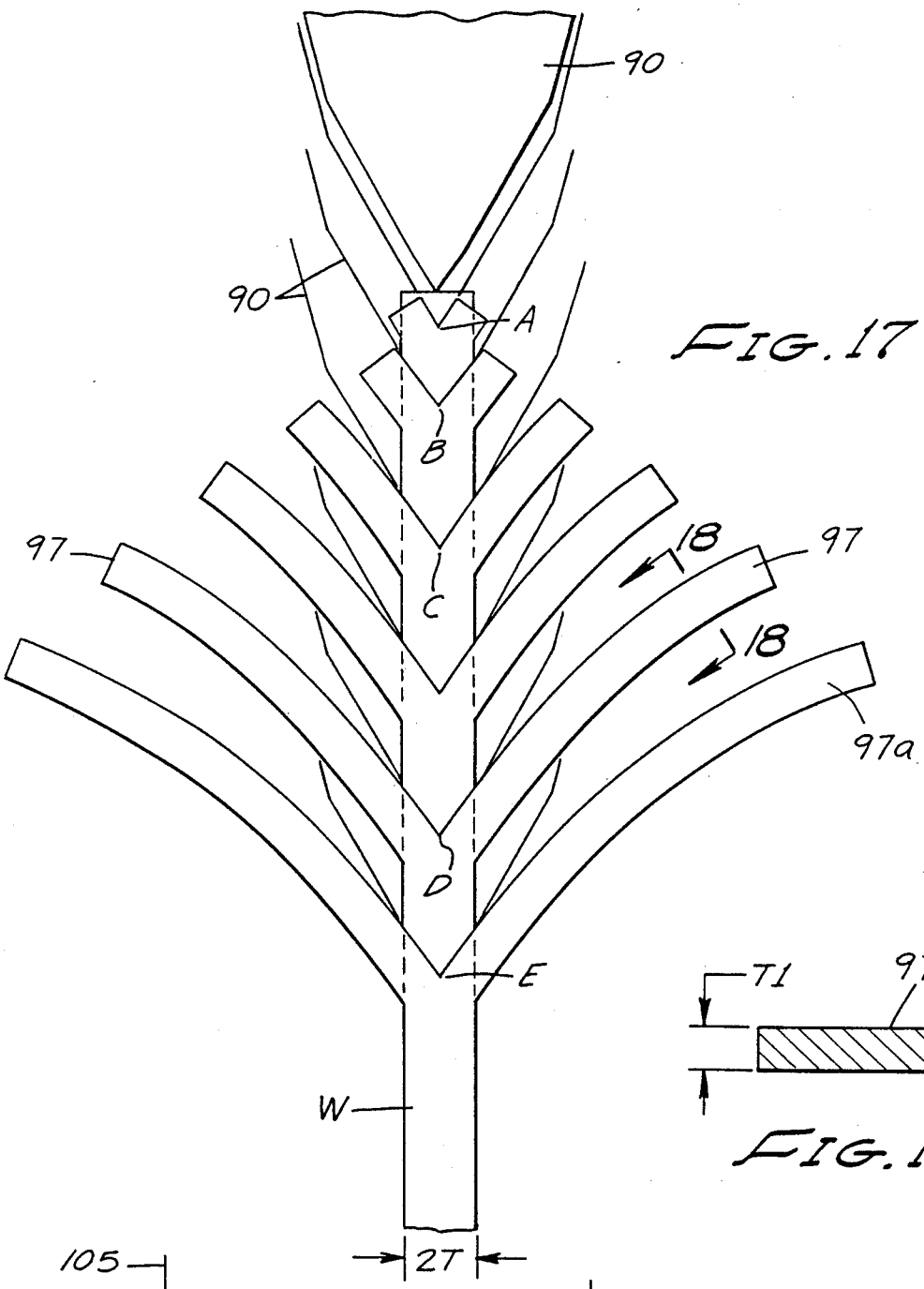
FIG. 17 is a generally schematic view illustrating the progressive splitting movement of the splitting punch as it advances relative to the workpiece and splits the workpiece substantially along the centerline thereof.

Referring particularly to FIG. 17 of the drawings, there is illustrated, by way of example, the shearing of a phosphor bronze workpiece W in accordance with the method of the instant embodiment of the invention. As shown in the upper portion of FIG. 17, the workpiece W, which has a thickness of about 0.025 inches, or 2 T, is being initially penetrated by the punch 90. At the point designated "A", the punch 90 has entered the workpiece approximately 0.011 inch and, as shown in the drawings, has created a "plowing" like effect on the material. As the punch 90 continues downwardly toward point "B" with sufficient force to evenly shear, but not tear, the material, substantial pre-shear compressive forces are continuously exerted on the workpiece at locations proximate the apex of the punch. The imposition of these very high, pre-shear compressive forces causes tho unexpected burnishing effect to occur on either side of the apex of the punch. It is this burnishing action which results in the formation of a remarkably fine finish on the sheared surfaces of the electrical contact. It is to be appreciated that as the punch moves downwardly shearing occurs simultaneously along five shear lines and, as a result, six surfaces are simultaneously created. These six surfaces are the inner surface of each tongue and the transversely spaced outer edges of each tongue.

By the time the cutter element, or punch, 90 has moved to point "C", it has generally bisected the workpiece to a depth of about 0.091 inches and the angularly diverging tongues of the contact are beginning to take shape. Continued movement of the punch to point "D" which, in the example shown in FIG. 17, represents a depth of on the order of 0.191 inches, results in the formation of the elongated angularly diverging tongues identified by the numeral 97. Examination of the inner surfaces of these tongues reveals the existence of a highly polished, very fine finish along their entire length. Examination of the tongues also reveals that they have become progressively thicker and that, if they were to be bent inwardly toward one another, their overall length would be less than the length of the unsupported area of the starting workpiece. The apparent reasons for this thickening of the tongue walls as well as the foreshortening effect will presently be discussed.

Figure 18:
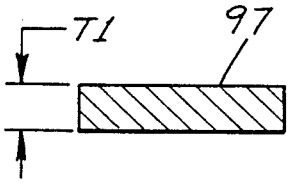
FIG. 18 is a cross-sectional view taken along lines 18—18 of FIG. 17.

Turning now to FIG. 18, which is a cross-sectional view of tongue 97 taken along lines 18—18 of FIG. 17, the thickness T1 of the tongue in the present example is on the order of 0.0153 inches. In light of the fact that the starting thickness 2 T of the workpiece was on the order of 0.025 inches and one-half this thickness, or T, was on the order of 0.0125 inches, it is apparent that a marked increase in wall thickness has occurred during the formation of tongue 97.

Experience has shown that for the same starting material, the smaller the angle "Z" formed on the punch the smaller will be the pre-shear compressive forces generated and the smaller will be the increase in average thickness of the angularly diverging tongues. Depending upon the character of the starting material, a reduction in the size of angle "Z" will also result in a more moderate curling of the diverging tongues. Accordingly, it is to be understood that tongue configuration can be precisely controlled by choice of materials, and by changing the angle "Z" formed on the punch. Additionally, the length of the tongues can be controlled by controlling the depth of travel of the punch 90. For example, longer tongues 97*a* can be formed as a result of further downward travel of the punch to a point "E" (FIG. 17). However, experimentation has revealed that, with most starting materials, after a certain depth of penetration of the punch has been reached, the thickness of the tongues will stabilize and will not further increase in thickness.

It is to be understood that the results described in the preceding paragraphs vary somewhat depending upon the character of the starting material. As a general rule, however, the softer the starting material and the more obtuse the shearing punch angle, the greater will be the thickening of the tongues and the greater will be their foreshortening. The reverse is true when harder starting materials and sharper shearing punch angles are employed. The table which follows illustrates these results (thicknesses and lengths are expressed in inches and punch angle is expressed in degrees).

| SAMPLE NO. | TEMPER MATERIAL | THICKNESS OF MATERIAL | PUNCH ANGLE | STARTING LENGTH | TONGUE LENGTH | TONGUE THICKNESS |
|---|---|---|---|---|---|---|
| 1 | CA260 annealed brass | 0.025 | 40 | 0.345 | 0.270 | 0.017 |
| 2 | CA260 annealed brass | 0.025 | 50 | 0.345 | 0.2485 | 0.0183 |
| 3 | CA260 annealed brass | 0.025 | 60 | 0.345 | 0.2295 | 0.020 |
| 4 | CA260 ¾ hard | 0.025 | 40 | 0.345 | 0.295 | 0.0156 |
| 5 | CA260 ¾ hard | 0.025 | 50 | 0.345 | 0.2735 | 0.0158 |
| 6 | CA260 ¾ hard | 0.025 | 60 | 0.345 | 0.255 | 0.0179 |
| 7 | CA510 ½ hard phosphor/ bronze | 0.025 | 40 | 0.345 | 0.3015 | 0.0145 |
| 8 | CA510 ½ hard phosphor/ bronze | 0.025 | 50 | 0.345 | 0.286 | 0.0152 |
| 9 | CA510 ½ hard phosphor/ bronze | 0.025 | 60 | 0.345 | 0.273 | 0.0158 |
| 10 | CA510 ¾ hard | 0.025 | 40 | 0.345 | 0.305 | 0.0148 |
| 11 | CA510 ¾ hard | 0.025 | 50 | 0.345 | 0.290 | 0.0156 |
| 12 | CA510 ¾ hard | 0.025 | 60 | 0.345 | 0.280 | 0.0162 |
| 13 | CA510 full hard | 0.025 | 40 | 0.345 | 0.3155 | 0.0143 |
| 14 | CA510 full hard | 0.025 | 50 | 0.345 | 0.2995 | 0.0148 |
| 15 | CA510 full hard | 0.025 | 60 | 0.345 | 0.295 | 0.0155 |
| 16 | CA510 full hard | 0.020 | 50 | 0.345 | 0.3095 | 0.0115 |
| 17 | CA510 full hard | 0.020 | 60 | 0.345 | 0.2995 | 0.0118 |

Figure 19:
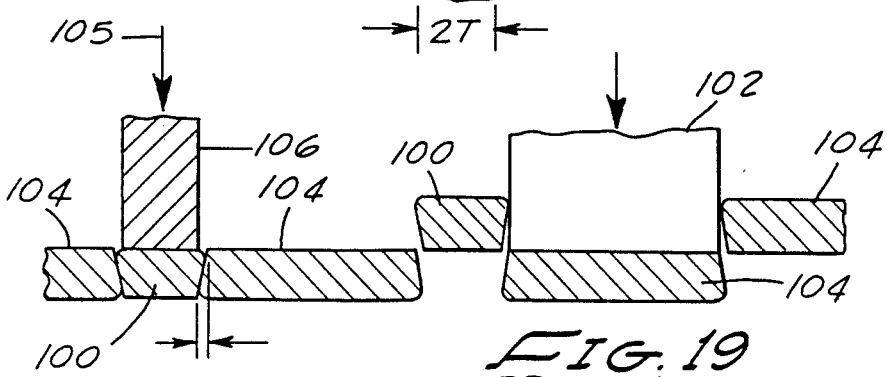
FIG. 19 PRIOR ART
FIG. 19 is a generally diagrammatic view comparing the prior art method of removing the slug portion of the work material with the removal of the slug portion in accordance with the present invention.
Figure 20:
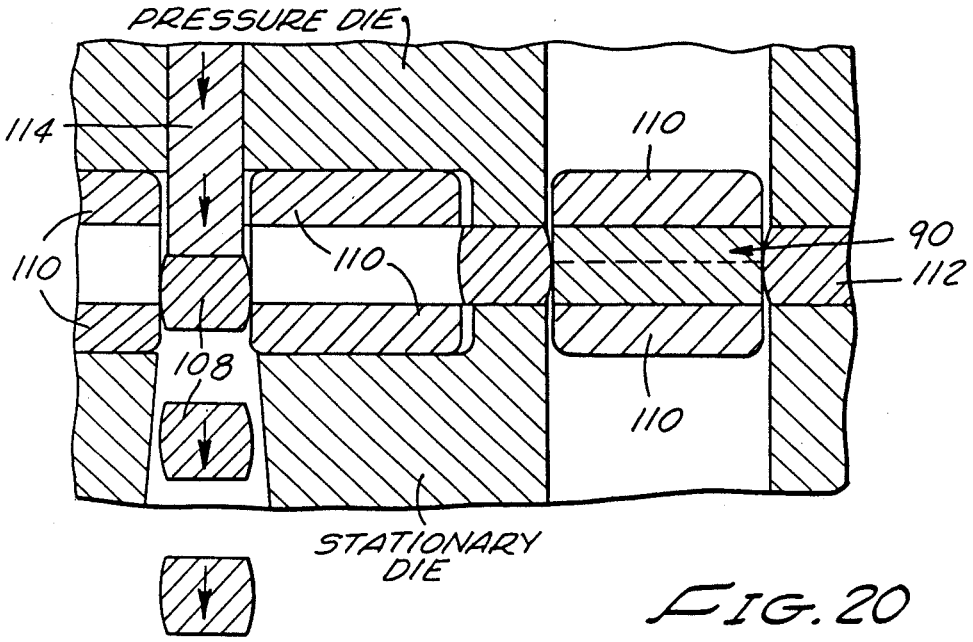
FIG. 20 is an enlarged generally diagrammatic view further illustrating the slug removal step.

Turning to FIGS. 19 and 20, the present method of slug removal is compared with a typical prior art slug removal step. As shown in FIG. 19, which illustrates the prior art conditions, the slug, or adjacent part, is identified by the numeral 100, the blank punch is indicated by the numeral 102 and the starting material is identified by the numeral 104. Referring to the left hand portion of FIG. 19 the interference between the slug 102 and the blank 104 is at once apparent. If pressure is exerted in the direction of the arrow 105 on the slug knockout punch 106 the interference between the slug and the blank resists removal of the slug. Accordingly, in the prior art the slug 100 is normally removed in the opposite direction as indicated in the right hand portion of FIG. 19.

Turning to FIG. 20 which illustrates slug removal in accordance with the method of the present invention, the slug, or adjacent part, is identified by the numeral 108, the blanks by the numeral 110 and the starting material by the numeral 112. In light of the highly burnished surfaces formed on the electrical contacts due to the shearing by the present method of the invention, slug removal takes on greater significance since it is highly desirable that the highly polished surfaces be carefully preserved. As shown in the right hand portion of FIG. 20, the punch 90 has sheared the starting material in a unique manner such that the tongues 110 conform, not to the die, but rather to the width of the punch. this unexpected and unusual phenomenon of the sheared material conforming to the shape of the punch rather than to the die, will be discussed in greater detail hereinafter. Suffice to point out at this time, that this conformation permits ready removal of the slug in the manner shown in the left hand portion of FIG. 20. Because of the clearance, which results, the knock out punch 114 can more easily remove the plug, or adjacent part, in the same direction as the travel of the die and indicated by the arrows. Similarly, the sheared tongues can be readily removed from the die, without damage.

Figure 21:
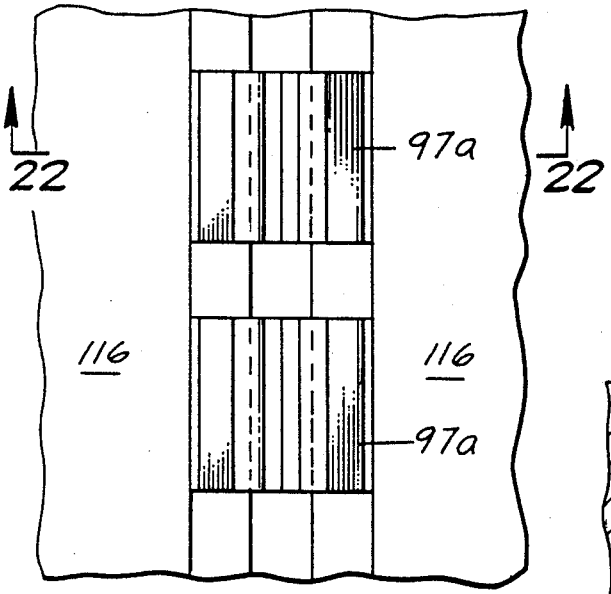
FIG. 21 is a fragmentary top view of the finished electrical contact formed by an alternate form of the method of the present invention.
Figure 22:
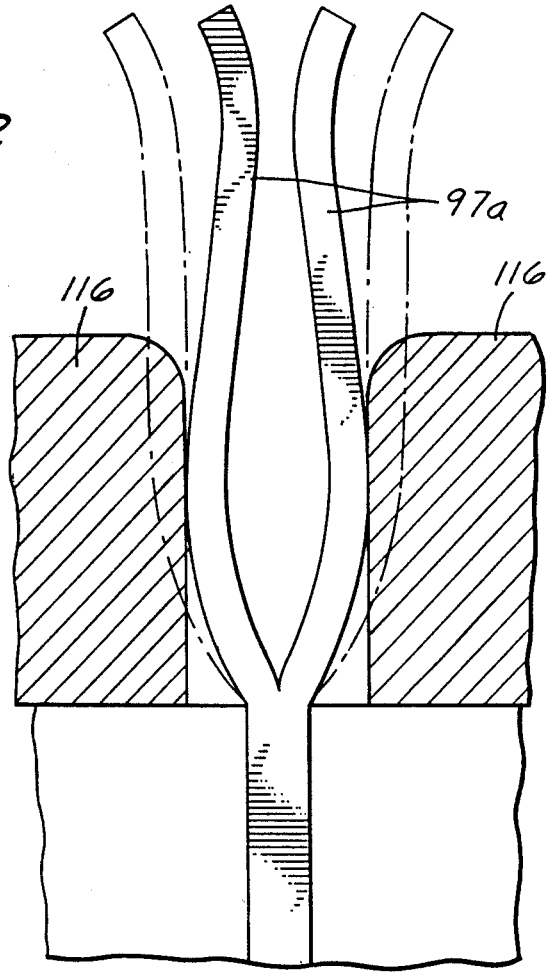
FIG. 22 is a side elevational view taken along lines 22—22 of FIG. 21.

Referring now to FIGS. 21 and 22, a contact forming step is there illustrated. As previously discussed, and as shown in FIG. 17, as the punch advances the angularly diverging tongues of the contact will be formed. The converged configuration of the tongues naturally results and, as earlier stated, can be controlled to some degree by varying the angle "Z" of the punch. Accordingly, the method of the present invention makes it possible to produce electrical contacts in a desired final configuration by merely exerting controlled bending pressures on the diverging tongues using forming dies of the character shown in FIG. 22 and designated therein by the numeral 116. By exerting inwardly directed pressures on the specially configured dies 116 the tongues 97*a* of the contact can be formed from the as sheared configuration generally illustrated by the phantom lines into the desired final configuration illustrated by the solid lines. This method of forming the contact in its final configuration also tends to further preserve the highly polished surfaces of the contact which have been automatically formed during the shearing step.

Turning now to FIGS. 23 through 26, the novel feature of the invention, namely the conformation of the tongues to the punch, is further illustrated. As discussed in the preceding paragraphs, with the opposing surfaces of the workpiece substantially supported throughout their entire area, save for an unsupported area of the desired size and configuration, the method of the present invention permits the formation of contacts having tongues which closely correspond to the configuration of the punch of the shearing apparatus. This feature of the invention not only permits the forming of contact tongues having a width less than the width of the unsupported area of the workpiece, but also permits the forming of contact tongues of various cross-sectional configurations.

Figure 23:
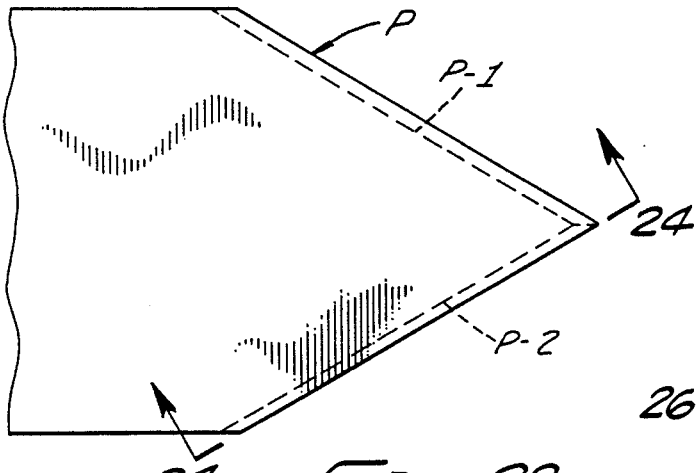
FIG. 23 is a fragmentary plan view of another form of splitting punch having concave shearing faces.

As indicated in FIG. 23, the punch P of the apparatus of the invention can be formed such that the angularly extending shearing faces P-1 and P-2 of the punch are generally concave. When this type punch is used in connection with a die of the character illustrated in FIG. 1, contacts having tongues 120 with concave surfaces of the character illustrated in FIGS. 25 and 26, can be formed.

Turning to FIGS. 27 through 30, the punch P of the apparatus of the invention can be formed such that the angularly extending shearing faces P-2 and P-4 of the punch are generally convex. When this type of punch is used with dies of the character shown in FIG. 1, contacts having tongues 122 with convex surfaces of the character illustrated in FIGS. 29 and 30, can be formed. In either case tongues having a highly polished inner surface are automatically produced.

Figure 25:
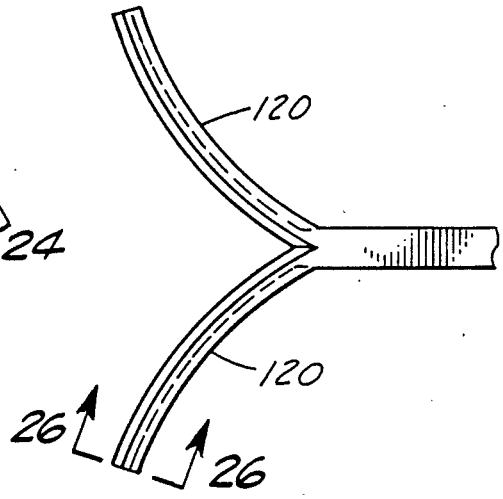
FIG. 25 is a fragmentary plan view of a rough contact made using the punch illustrated in FIG. 23.
Figure 24:
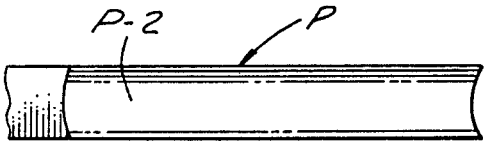
FIG. 24 is a view taken along lines 24—24 of FIG. 23.
Figure 26:
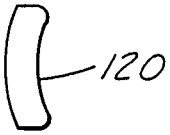
FIG. 26 is a view taken along lines 26—26 of FIG. 25.
Figure 27:
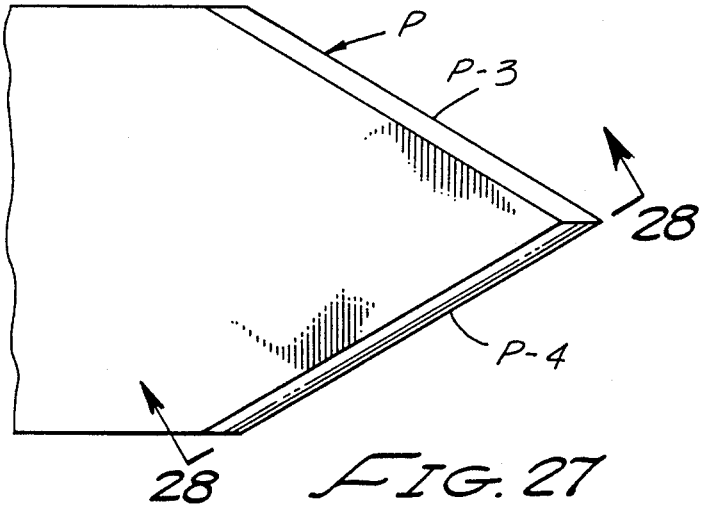
FIG. 27 is a fragmentary plan view of another form of splitting punch having convex shearing faces.
Figure 29:
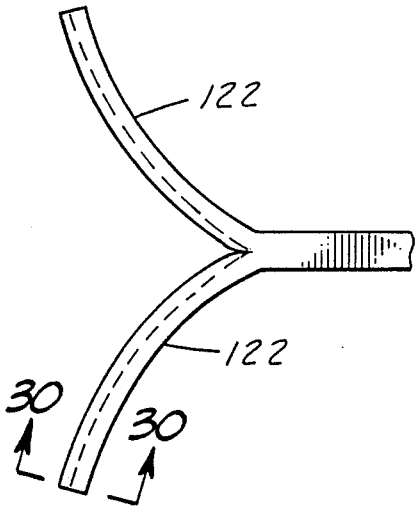
FIG. 29 is a fragmentary plan view of a rough contact made using the punch illustrated in FIG. 27.
Figure 28:
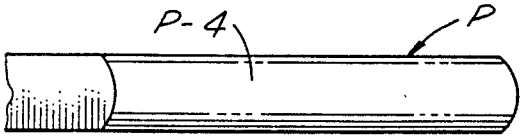
FIG. 28 is a view taken along lines 28—28 of FIG. 27.
Figure 30:
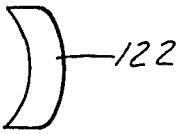
FIG. 30 is a view taken along lines 30—30 of FIG. 29.

It is apparent that the formation of high quality electrical contacts having tongues of various cross-sectional configurations, as for example concave or convex, has great commercial advantage. In applications where the pin with which the electrical contact is to mate is preferably cylindrical in shape, contacts having concave surfaces as illustrated in FIG. 25, can be expeditiously formed to closely mate with the cylindrical pin. Conversely, if the pin with which the contact is to mate is of a dished out configuration, contacts having the configuration shown in FIG. 29 can be formed. In a similar manner, a contact can be formed to mate with virtually any shaped pin by simply designing the punch of the apparatus accordingly.

It is to be understood that the method and apparatus of the invention, as previously described herein, can be used to manufacture a wide variety of useful devices. Such devices include; end products such as electrical contacts, thermal contacts, fasteners of various kinds, and similar types of hardware, as well as interim configurations of these products. When electrical contacts are to be fabricated, the starting material is, of course, electrically conductive. On the other hand, when thermal contacts, such as may be used in heat dissipation systems, are to be fabricated, thermally conductive material is used as the starting material. For other types of hardware devices, end product use will govern the choice of starting material.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A method of making a contact member from a generally planar shaped workpiece of conductive material of a predetermined thickness having first and second generally parallel faces of a predetermined area terminating in a third face of a predetermined width comprising the steps of:

(a) continuously supporting said first and second faces of the workpiece substantially throughout the entire area thereof save for first and second unsupported area of predetermined width and length on each of said first and second faces disposed adjacent to said third face to prevent lateral deformation of said first and second faces save for deformation in said unsupported areas of predetermined width and length located on said first and second faces; and (b) while continuously, supporting said first and second faces of the workpiece, imparting a shearing force to said third face of said generally planar shaped workpiece at a location along the width of said unsupported area and intermediate said first and second faces to form first and second tongues, a substantial portion of each of said tongues having a thickness greater than one-half the thickness of the generally planar shaped workpiece.

2. A method as defined in claim 1 in which said shear force imparted to said third face in a manner to produce a burnishing of the sheared surfaces of said tongue-like members to form a highly polished surface thereon.

3. A method as defined in claim 1 in which said shear force is imparted to said third face in a manner whereby the width of each said tongue is less than the width of said unsupported areas.

4. A method as defined in claim 1 in which said shear force is imparted to said third force in a manner whereby the length of each said tongue is less than the length of said unsupported areas of said workpiece.

5. A method as defined in claim 1 including the step of forming said tongues into a predetermined curved configuration simultaneously with imparting the shearing force to said third force of said workpiece.

6. A method as defined in claim 1 the further step of separating said contact from the workpiece by exerting forces on said planar shaped workpiece proximate said third face, said forces being exerted in the same direction as said shearing force.

7. A method of making a device of the character having a pair of diverging tongues, each tongue having transversely spaced edges and opposing inner faces from a generally planar shaped workpiece of a predetermined thickness having first and second generally parallel faces of a predetermined area terminating in a third face of a predetermined width comprising the steps of:

(a) continuously supporting said first and second faces of the workpiece throughout the entire area thereof save for unsupported areas of predetermined width and length on each of said first and second faces disposed adjacent to said third face; and (b) while continuously supporting said first and second faces of the workpiece throughout the entire area thereof save for the unsupported areas, imparting a shearing force to said third face of said generally planar shaped workpiece at a location along the width of said unsupported area and intermediate said first and second faces thereof to simultaneously form six generally planar surfaces defining the edges and inner, opposing surfaces of said tongues.

8. A method of making a device as defined in claim 7 for use as a contact member in which the shear force is imparted to said third face of said workpiece in a manner to form inner, opposing surfaces of the electrical contact member which are generally concave in cross-section.

9. A method of making an electrical contact as defined in claim 7 in which the shear force is imparted to said third face of said workpiece in a manner to form inner opposing surfaces of the contact member which are generally convex in cross-section.

10. An apparatus for making a contact member from a generally planar shaped workpiece of conductive material of a predetermined thickness having first and second generally parallel faces terminating in a third face said contact member having a pair of outwardly diverging tongues of a predetermined configuration, said apparatus comprising:

(a) a supporting body having a workpiece receiving cavity formed therein;

(b) workpiece supporting means closely receivable within said cavity of said supporting body for rigidly supporting the first and second faces of said workpiece throughout their entire area save for an unsupported portion of predetermined size; and (c) shearing means closely receivable within said cavity of said supporting body for imparting a shearing force to said third face of the workpiece at a location proximate said unsupported area and intermediate the first and second faces thereof to controllably generally bisect the unsupported portion of the workpiece, said shearing means comprising a punch closely receivable within the cavity formed in said supporting body, said punch including:

(i) a body portion; and (ii) a cutter portion carried by said body portion, said cutter portion having walls tapering inwardly at a predetermined angle to define an included angle of between about 60 degrees and about 80 degrees, and terminating in an apex defining a shearing edge.

11. An apparatus as defined in claim 10 in which said included angle of said cutter portion is approximately 70 degrees.

12. An apparatus for shearing a generally planar shaped workpiece of a predetermined wall thickness having first and second generally parallel faces terminating in a third face of a predetermined width, to form a pair of outwardly diverging, tongue-like members of a predetermined size and shape, said apparatus comprising:

(a) workpiece supporting means for continuously supporting the first and second faces of said workpiece, during shearing throughout substantially their entire areas save for a shear area of a predetermined width and length, said workpiece supporting means comprising:

(i) a first supporting element having a first face for engagement with said first face of the workpiece throughout the entire area thereof save for said shear area; and (ii) a second supporting element having a first face for engagement with the second face of the workpiece throughout the entire area thereof save for said shear area;

(b) shearing means for imparting a shearing force to said third face of said generally planar shaped workpiece to controllably generally bisect the workpiece intermediate two generally parallel lines transversely spaced apart a distance slightly less than the width of said shear area to form the tongue-like members, said shearing means comprising a punch having a width slightly less than the width of said shear area, said punch including side walls tapering inwardly at a predetermined angle.

13. An apparatus as defined in claim 12 for forming a contact having a pair of outwardly diverging tongue-like members, each of said tongue-like members having an average wall thickness greater than one half the wall thickness of the workpiece.

14. An apparatus as defined in claim 13 in which said contact has a length less than the length of said unsupported area.

15. An apparatus as defined in claim 13 in which said side walls of said punch are generally concave in cross-section.

16. An apparatus as defined in claim 13 in which said side walls are generally convex in cross-section.

17. An apparatus as defined in claim 13 for forming an electrical contact.

18. An apparatus as defined in claim 13 for forming a thermal contact.

* * * * *